United States Patent [19]

Johansson et al.

[11] 3,958,549

[45] May 25, 1976

[54] AIR RIFLE HAVING A DETACHABLE REAR BODY

[75] Inventors: Lennart J. I. Johansson; Bjorn W. Lindqvist, both of Eskilstuna; Eric V. Wallberg, Vallingby, all of Sweden

[73] Assignee: Forenade Fabriksverken, Eskilstuna, Sweden

[22] Filed: Apr. 30, 1974

[21] Appl. No.: 465,685

[30] Foreign Application Priority Data

May 4, 1973 Sweden ..... 7306501

[52] U.S. Cl. ..... 124/67

[51] Int. Cl.[2] ..... F41B 11/00; F41F 1/04

[58] Field of Search ..... 124/15, 37, 40

[56] References Cited

UNITED STATES PATENTS

| | | | |
|---|---|---|---|
| 906,309 | 12/1908 | Schobbert | 124/15 |
| 1,045,373 | 11/1912 | Cook | 124/15 |
| 1,136,470 | 4/1915 | Lefever | 124/15 |

FOREIGN PATENTS OR APPLICATIONS

| | | | |
|---|---|---|---|
| 1,180,276 | 10/1964 | Germany | 124/15 |
| 378,727 | 7/1964 | Switzerland | 124/15 |

*Primary Examiner*—Richard C. Pinkham
*Assistant Examiner*—Richard T. Stouffer
*Attorney, Agent, or Firm*—Eric Y. Munson

[57] ABSTRACT

An air rifle comprising a tubular casing in which the barrel is mounted. The bullet or other projectile is propelled by the escape of compressed air from a compression chamber produced by a forceful spring actuated movement of a piston having a deformable piston head which strikes a channelled funnel-shaped cap member which forms gas tight closure for the forward end of a compression cylinder within which the piston moves and which also forms a seal around the projectile seat in the shooting position of the compression cylinder. The compression cylinder slideably engages the walls of the tubular casing which has a normally open rear end to which is detachably connected a closure member or rear body which serves as an abutment for the spring and also to support the trigger mechanism and a trigger guard. The rifle is cocked by actuation of a lever mechanism which is pivotally connected to the tubular casing and to the rear body and includes a draw bar which is pivoted to the cap member. The actuation of the draw bar causes the compression cylinder to move to the rear, carrying with it through the instrumentality of the cap member the piston which thus compresses the spring. Upon having reached its cocked position, the piston is engaged by spring-urged retaining structure: which locks it in the cocked position, whereupon the compression cylinder with its closure cap is returned by the lever mechanism to its forward position in seated engagement with the barrel. The tubular casing has a loading opening for insertion of a bullet or other projectile which becomes exposed during the cocking operation and is closed by the compression cylinder when the latter is returned to its shooting position.

6 Claims, 8 Drawing Figures

AIR RIFLE HAVING A DETACHABLE REAR BODY

BACKGROUND OF THE INVENTION

The present invention relates to an air rifle of the type comprising a tubular casing, a barrel mounted in the casing, a compression cylinder displaceable within the casing and a spring actuated piston movable in the same, and a tension mechanism for recoiling the piston spring.

Among the objects of the invention is to produce an air rifle of the type referred to above which can easily be disassembled, which is simple in construction and which makes it possible to attain a substantially high air compression in the compression cylinder with resultant high projectile velocity. Another object of the invention is to provide a fairly inexpensive and well-balanced air rifle with improved performance characteristics suitable for precision shooting.

SUMMARY OF THE INVENTION

The characteristic features of the invention whereby it has been possible to attain these advantageous qualities will be clear from the claims appended to the specification.

According to the invention the casing can be made so short that the firing mechanism can be arranged in a separate rear body which in addition to forming a means of attachment for the trigger guard provides a seat in the space available for the lock device in the stock of the rifle. This rear body when attached to the casing closes the latter and constitutes a support surface for the piston spring which imparts the advantage that the interior of the casing can be quite smooth with no shoulder means to support the piston spring and thus leaving the casing entirely open at the rear. The parts in the casing can therefore be easily removed rearwardly after the rear body has been detached from the casing. Since the rear body must be substantially long it is possible to make it so stable and fasten it so firmly to the casing that the piston spring can be dimensioned to create a relatively high air pressure in the cylinder compression chamber. It has been shown that in a rifle made in accordance with the invention the piston spring acts on the piston with a force about 60 kp.

DESCRIPTION OF AN EMBODIMENT OF THE INVENTION

Figure 1:
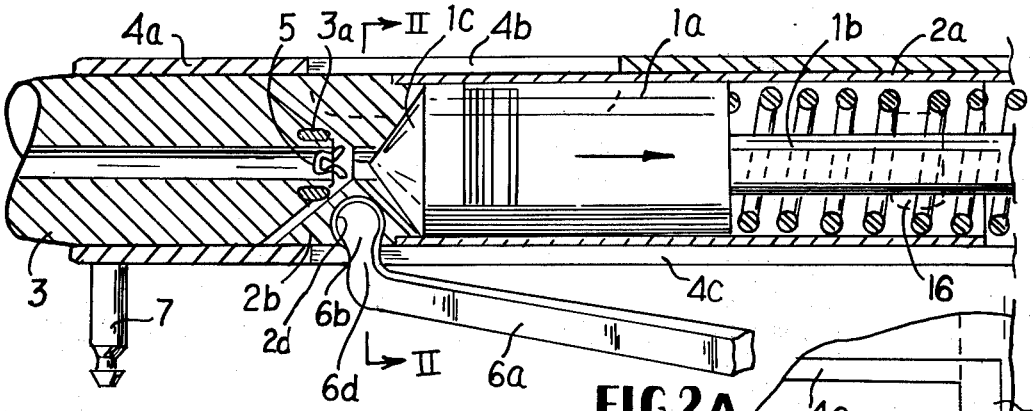
FIG. 1 shows a longitudinal fragmentary section of the barrel and the rifle casing comprising a rear portion of the barrel, a forward portion of the casing, the compression cylinder with attached tension draw bar, the piston and the forward portion of the piston spring.
Figure 3:
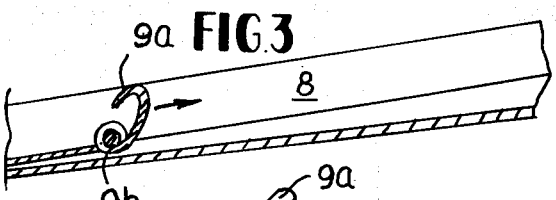
FIG. 3 shows in longitudinal section a portion of the tension lever and a catch fitted thereon.
Figure 3A:
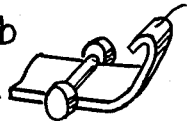
FIG. 3*a* shows a detail of the catch.

As appears from FIG. 1 a barrel 3 is mounted in a cylindrical tubular casing 4*a* having an opening 4*b* on the upper side which is exposed when a compression cylinder which is slideably arranged in the casing 4*a* and comprising a cylindrical tube 2*a* and a cap member 2*b* mounted thereon in gas tight relationship is moved rearwardly so that the projectile 5 can be inserted in a projectile seat in the rear end of barrel 3. The cap member 2*b* has conical funnel-shaped front and rear surfaces and a comparatively thin central portion which defines a hole 2*c* constituting a connecting channel between the compression chamber of the compression cylinder and the barrel projectile seat. In order to attain a good seal between cap member 2*b* and barrel 3 the rear portion of the latter has a corresponding inverted conical shape and is provided with a concentric groove in which is inserted a sealing nylon ring 3*a*. A spring loaded piston 1*a* which is movable in the compression cylinder 2*a* and having sealing rings in close contact with the cylinder wall is in its forward end provided with a conical head 1*c* of a synthetic rubber which is adapted to conform to the funnel of cap member 2*a*. Because of these conical end surfaces piston 1*a* almost reaches projectile 5 in spite of the comparatively long cap member 2*b*, and "the dead space volume" therefore becomes small upon compression and is further reduced due to the fact that the synthetic rubber head of the piston 1*c* is deformable so that it penetrates into the central channel 2*c* of the cylinder cap member 2*b* upon impingement therewith.

Figure 4:
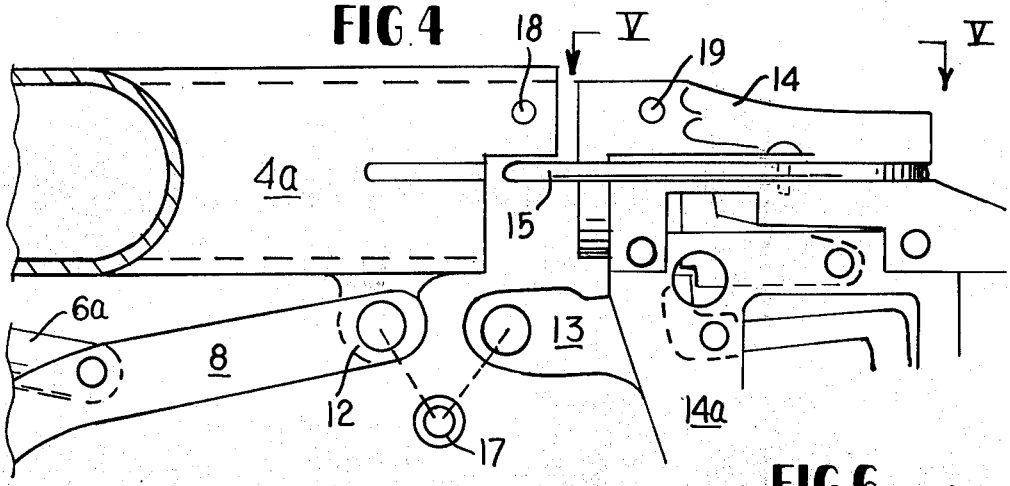
FIG. 4 shows a side elevation of the rear portion of the casing and the back slightly separated from each other.

The rear end of casing 4*a* which normally is entirely open is closed by a strong comparatively long rear body 14 having a trigger guard 14*a* and a firing mechanism which is mounted therein as shown in FIG. 4.

The rear body 14 has a forward, cylindrical portion which can be inserted in casing 4*a* and attached to the same by means of a pin inserted through registering holes 18 and 19 at the top of the casing and the rear body respectively and a tubular shaft 17 which is inserted through registering holes in a lug 12 projecting from the underside of casing 4*a* and in two lugs 13 projecting from trigger guard 14*a*. The rear end of piston spring bears against the front end surface of the rear body 14 which by reason of its shape and attachment to the casing is capable of absorbing a high spring load. It is therefore possible to dimension the piston spring so as to compress the air to a relatively high pressure. This implies of course that a correspondingly strong force is needed for the rearward or cocking movement of compression cylinder 2*a* and piston 1 when compressing the piston spring.

For the purpose of displacing the compression cylinder 2*a* a tension mechanism is arranged beneath the casing comprising a tension lever 8 the rear end of which is pivotally mounted on the tubular shaft 17 (see FIG. 4) and a tension draw bar 6*a* which is hingedly connected to the tension lever 8 and the forward end portion of which is inserted in a longitudinal slot 4*c* in the bottom of casing 4*a* and hingedly connected to cap member 2*b*. Tension lever 8 has a U-shaped cross-sectional profile with its open end facing upwards so that it encloses tension draw bar 6*a* when it is folded against the casing 4*a* in its position of rest. The entire tension mechanism is of very simple construction and inexpensive to manufacture and so narrow in width that in its locked position of rest it lies retracted in the stock of the rifle which would be impossible if tension lever 8 should have been connected rearwardly of trigger guard 14*a*. It would then have been necessary to shape the tension lever with portions surrounding trigger guard 14*a* and thus be so wide that it would have been impossible to retract it into the stock of the rifle and into the slot 4*c*.

Figure 2A:
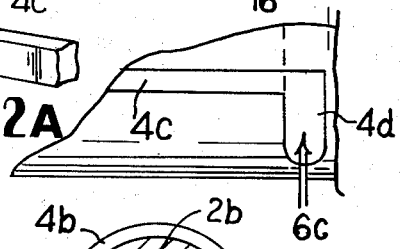
FIG. 2*a* shows the rear portion of the casing seen from below and illustrating the attachment of the tension draw bar to the cylinder.
Figure 2:
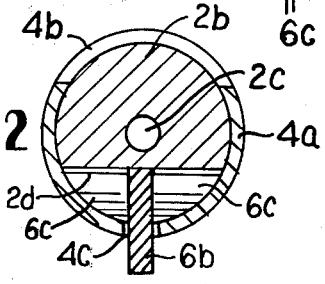
FIG. 2 a cross section taken along II—II in FIG. 1 showing the tension draw bar attachment in the compression cylinder.

The cap member 2*b* is provided with a bore 2*d* which extends transversely through the cap member and serves as bearing surface for the cylindrical head 6*b* which merges with the draw bar 6*a* by means of the neck 6*d*. The head 6*b* is inserted in the bore 2*d* and held in place by means of two identical plugs 6*c* as shown in detail in FIG. 2.

Figure 5:
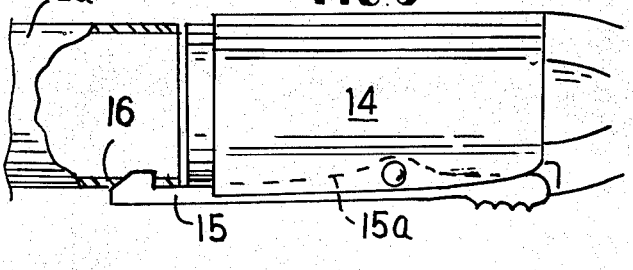
FIG. 5 shows the rear body and the rear end of the compression cylinder seen from above.
Figure 6:
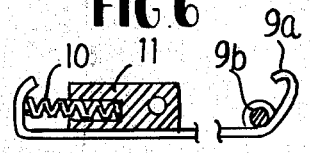
FIG. 6 shows the tension lever locking device.

Piston stem 1*b* is provided with a conventional hook not shown for catching the piston on a sear in the firing mechanism when compressing the piston spring. In view of the high spring loads which are rendered possible through the invention it is however highly desirable for safety reasons that the compression cylinder is also locked in its retracted position during the loading operation as the risk exists that the trigger may be touched unintentionally and thus release the piston. The length and construction of the rear body 14 renders it possible to store therein a safety switch for the compression cylinder. As shown in FIG. 4 and FIG. 5 it can be arranged as a spring loaded rocker arm 15 which is partly recessed in rear body 14 and casing 4*a* and the forward end of which is provided with a deep recess to form a hook which is automatically inserted in an opening 16 in the rear portion of cylinder 2*a* and retains the same in cocked position. In order to release the cylinder pressure is exerted against the rear end of the rocker arm on the side thereof indicated by 15*a* to overcome the spring load and in the case of the provision of a hook the cylinder must simultaneously be drawn slightly backwards.

The air rifle is also provided with a locking device for locking the tension mechanism in retracted position and thereby the compression cylinder in its forward position. It consists of a latch pin 7 at the front end of casing 4*a* fastened to the bottom of the same and a catch clamp 9*a* which is arranged slidably within the front end of tension lever 8.

It will be apparent from the drawing that catch clamp 9*a* is slidably arranged at the inside of the free end of the compression lever 8 and is provided with a front and rear leg so that the rear leg is bent inwards and is held in engagement with latch pin 7 in a cavity at the bevelled free end of the latter under the influence of a forwardly directed spring load by the spring 10 which acts upon the front leg and a grip block 11 mounted on the lever 8 between the two legs. It will also be apparent that catch clamp 9*a* is also held by a shaft 9*b* which is provided with two end flanges pivotally engaged in a bore in the legs of compression lever 8 and retains catch clamp 9*a* in position in relation to latch pin 7. In this manner, the shaft 9*b* is locked in place. Grip block 11 which is designed to save the hand of the operator when compressing the piston spring is provided with a bore in which is inserted the helical spring 10 acting upon the forward shank of catch clamp 9*a*.

Tubular shaft 17 which keeps together casing 4*a* and rear body 14 and also constitutes mounting shaft for tension lever 8 forms also an excellent means for attaching to the stock of the rifle. With a stock bolt through the tubular shaft 17 as the only attachment means to the rear of barrel 3 all of said three parts are directly anchored to the stock. The whole system can also be assembled, test fired and trimmed without being connected to the stock of the rifle and then be easily mounted therein as an assembled unit. Another advantage is that the folding of the stock becomes a very simple operation.

We claim:

1. An air rifle comprising:

a. an open-ended longitudinally-extending tubular casing supporting a barrel having a bore providing a projectile seat;

b. a compression cylinder slidably mounted in said casing and having an open rear end;

c. a cap member having a channel aligned with said projectile seat closing the forward end of said compression cylinder and forming a seal about said projectile seat when the rifle is in shooting position;

d. a piston having a piston head reciprocably mounted within said compression cylinder defining a compression chamber for directing a blast of compressed gas to project a projectile from said projectile seat;

e. a compression spring housed in said compression cylinder for actuating said piston;

f. a rear body detachably connected to the open rear end of said tubular casing forming a closure therefor and supporting releasable retention means for said compression spring;

g. a trigger mechanism provided with a trigger guard for actuating said retention means;

h. a lever mechanism pivotally connected between said rear body and said cap member effective to move said compression cylinder to the rear and with it said piston to its cocked position and return said compression cylinder to its forward shooting position; and i. said lever mechanism comprising a tension lever fulcrumed at one end to a tubular shaft interconnecting a pair of brackets extending from said casing and from said rear body, respectively, and a draw bar pivotally connected between said tension lever at a location spaced from said fulcrumed end and said cap member.

2. An air rifle according to claim 1, in which said tubular shaft serves as a means of attachment for the rifle stock.

3. An air rifle according to claim 1, in which the said rear body additionally supports a hook-shaped lever engaging a recess in said compression cylinder for retaining the same in the cocked position to the piston during the insertion of the projectile.

4. An air rifle according to claim 1, in which said cap member and said piston head are deformable upon impingement against one another.

5. An air rifle according to claim 4, in which said piston head and the impinging surface of said cap member have nesting conical profiles to cause said piston head to penetrate said channel.

6. An air rifle according to claim 5, in which the surface of the cap member facing the barrel has a conical profile opposite to that of the piston-impinging surface within which is nested a correspondingly profiled portion of the barrel.

* * * * *